United States Patent [19]

Strobush

[11] 4,397,239

[45] Aug. 9, 1983

[54] DELAY FUNCTION MODULE FOR AMMUNITION

[75] Inventor: Victor H. Strobush, Bloomington, Minn.

[73] Assignee: Honeywell Inc., Minneapolis, Minn.

[21] Appl. No.: 243,177

[22] Filed: Mar. 12, 1981

[51] Int. Cl.[3] ..... F42C 9/00; F42C 15/26

[52] U.S. Cl. ..... 102/275; 102/230; 102/243

[58] Field of Search ..... 102/275, 272, 266, 268, 102/230, 243, 242, 240, 500

[56] References Cited

U.S. PATENT DOCUMENTS

| | | | |
|---|---|---|---|
| 785,540 | 3/1905 | Cartwright | 102/243 |
| 1,014,183 | 1/1912 | Schneider | 102/243 X |
| 1,234,574 | 7/1917 | Schneider | 102/230 |
| 1,706,802 | 3/1929 | Methlin | 102/275 |
| 3,103,172 | 9/1963 | Hutchison et al. | 102/275 X |
| 4,013,013 | 3/1977 | Davis | 102/275 |

FOREIGN PATENT DOCUMENTS

| | | | |
|---|---|---|---|
| 522213 | 9/1953 | Belgium | 102/275 |

*Primary Examiner*—David H. Brown
*Attorney, Agent, or Firm*—George W. Field

[57] ABSTRACT

A delay function modulator for insertion between the primary fuze and the warhead of a projectile, which relies on the time required for the movement of the plunger through a certain distance, then on the further movement of an internal firing pin under the influence of inertial force.

7 Claims, 1 Drawing Figure

SAFE

ARMED

DELAY FUNCTION MODULE FOR AMMUNITION

The invention herein described was made in the course of or under a contract, or subcontract thereunder, with the Department of the Army.

FIELD OF THE INVENTION

This invention relates to the field of balistic missiles, and particularly to a delay function module for incorporation in projectiles.

BACKGROUND OF THE INVENTION

It is known that the lethality of exploding projectiles can be increased, when used against penetrable targets such as aircraft, tanks, so forth, if a delay can be introduced between the instant at which the primary fuze of the projectile explodes. This delay allows the projectile to penetrate the target before exploding, rather than exploding outside the skin of the target which offers some protection against the explosion.

SUMMARY OF THE INVENTION

The present invention comprises a delay function module to be interposed between the primary fuze and the warhead of a projectile, in which a delay is introduced which is determined by the time required for a plunger to move through a given distance and initiate the firing of a booster charge for the projectile warhead, the plunger including a separate, internal firing pin the movement of which is inertially controlled to trigger the initiating discharge.

BRIEF DESCRIPTION OF THE DRAWING

In the drawing, in which like reference numerals identify corresponding parts throughout the several views.

DESCRIPTION OF THE PREFERRED EMBODIMENT

Figure 1:
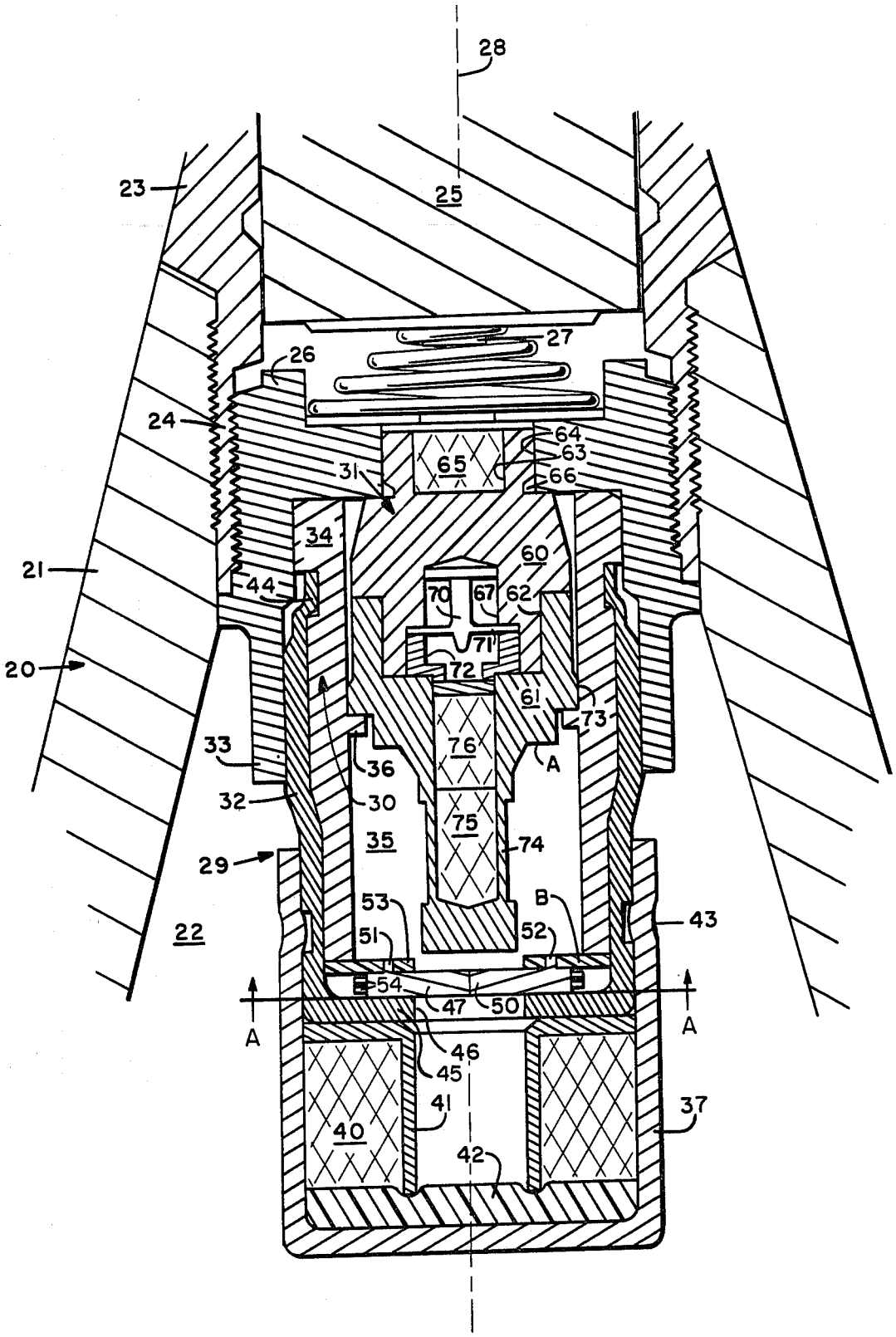
FIG. 1 is a fragmentary longitudinal section, partly schematic, of a projectile incorporating a delay module according to the invention.
Figure 2:
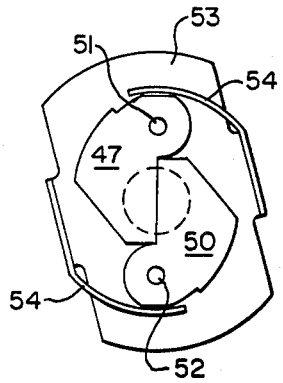
FIGS. 2 and 3 are schematic transverse sectional views generally along the line A—A of FIG. 1, showing first and second states of the apparatus.
Figure 3:
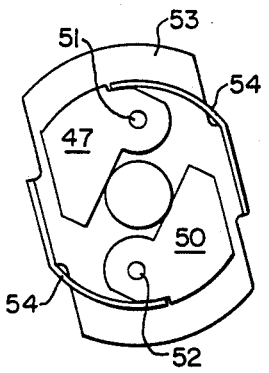

In the drawing a projectile 20 is shown schematically to comprise a body 21, containing a warhead 22, and a nose 23, connected to the body by a joint 24 and containing a primary fuze 25 mounted on a base 26 in a conventional fashion and including a detonator 27. In flight the projectile spins about a longitudinal axis 28.

Interposed between detonator 27 and warhead 22 is a delay function module 29 according to the invention. Module 29 comprises a housing 30 and a plunger 31. Housing 30 comprises an outer housing portion 32 secured to a rearward ring 33 of base 26, an inner housing portion 34 bored to provide a forward barrel 35 having a shear flange 36, and a booster cup 37 containing a rearward hollow charge of booster explosive 40 between a protector 41 and a pad 42. Cup 37 is crimped to outer housing portion 32 at a joint 43, and the housing portions are crimped together at a joint 44.

Outer housing portion 32 has a bottom 45 axially spaced from the rear end of portion 34, with a central aperture 46 which is normally closed off by a barrier in the form of a pair of arms 47, 50 pivoted at 51 and 52 to a mounting plate 53 and normally maintained in mutual contact by a spring 54 integral with plate 53. The arms are so configured that they respond to centrifugal force, resulting from spin of the projectile, by separating so that aperture 46 is clear.

Plunger 31 comprises a body 60 and a stem 61 interconnected at a joint 62. Body 60 includes a forward chamber 63 secured in an axial bore 64 in base 26 and containing a detonating propulsion explosive 65 positioned for ignition by detonator 27 of fuze 25. Chamber 63 is joined to the remainder of body 60 by a shearable neck 66. Body 60 has a central stepped bore 67 to receive an inertial firing pin 70 having a shear flange 71 gripped between the step of bore 67 and a clamping ring 72 engaged by stem 61. Stem 61 has a shoulder 73 which is a sliding fit in barrel 35 above flange 36 and normally engages flange 36 on the side thereof remote from the warhead.

Rearwardly stem 61 is reduced in diameter to comprise a finger 74 to be received in the hollow of booster charge 40. The stem is hollow, and encloses an explosive charge 75 and a detonator 76 in axial alignment with firing pin 70.

OPERATION

The operation of the invention can now be made plain. Shear flanges 36 and 71 and neck 66 are dimensioned to remain intact under the acceleration accompanying firing of the projectile. The resulting spin of the projectile, however, causes arms 47 and 50 to overcome the force of spring 54 and clear aperture 46.

Upon target impact primary fuze 25 discharges, but cannot at that instant initiate explosion of warhead 40 because module 29 is interposed. The propulsive charge in chamber 63 is however ignited: this deforms the wall of chamber 63 more firmly into engagement with base 26, and forces plunger 31 rearwardly, shearing off the chamber at neck 66. The propulsive force is so great that shear flange 36 yields, allowing the plunger to move rearwardly with an acceleration of many thousand g's. This force acting on inertial firing pin 70 causes yielding of shear flange 71, the firing pin moving forwardly relative to the body 60, although both are of course moving rearwardly in the projectile. Finger 74 passes through aperture 46, surface A of stem 61 contacts surface B of plate 53 halting the rearward movement of the plunger. The inertia of pin 70 now drives it rearwardly, through ring 72 and against detonator 76, firing charge 75 to fire booster explosive 40, which in turn fires warhead 22.

For a modulator used with 40 millimeter projectiles it is found that the time from target impact to projectile firing constitutes a delay of 300 microseconds, which allows complete penetrating of a vehicle by the projectile before the explosion.

From the above it will be evident that in this arrangement there is no reliance on projectile deceleration, due to target resistance, to set off the warhead. On the other hand, impact of a dense target will not shorten the delay time, as sometimes happens with pressure-rise or pyrotechnic delay devices.

From the foregoing it will be evident that I have invented a delay function modulator for insertion between the primary fuze and the warhead of a projectile, while relies for delay on the time required for the movement of a plunger through a certain distance, then on the further movement of an internal firing pin under the influence of inertial forces.

I claim:

1. A delay function module to be interposed axially between the primary fuze and the warhead of a projectile having an axis, extending from a forward end to a rearward end, about which said projectile spins in flight, said module comprising a housing, having an axially hollow rearward charge of booster explosive and a forward axial barrel, and a plunger coaxial in said barrel and having a rearward stem and a forward body, said body having an axially rearward cavity and terminating forwardly in a chamber necked to be shearable therefrom and containing a charge of explosive, and said stem being rearwardly configured to be received in the hollow of said booster charge and containing a further explosive charge with a detonator at the forward end thereof; an inertial firing pin in said rearward cavity of said body, aligned with said detonator and shorter than said cavity;

shearable means normally spacing said firing pin from the forward end of said cavity and from said detonator, and preventing axial movement of said pin in said cavity;

and means normally spacing said plunger in said barrel from said booster charge and effective to prevent rearward movement of said plunger in said barrel.

2. A modulator according to claim 1 in which the last name means includes a shear flange.

3. A modulator according to claim 1 in which the last name means includes a centrifugally retractable barrier.

4. A modulator according to claim 1 in which the last name means includes a shear flange and a centrifugally retractable barrier.

5. The method of introducing delay between the firing of the primary fuze of a projectile and the firing of the warhead of the projectile which comprises the steps of (1) accelerating a plunger rearwardly within the projectile upon firing of the primary fuze, (2) inertially delaying the acceleration of a firing pin within the plunger, (3) decelerating the plunger after it has moved a predetermined distance with respect to the projectile, and (4) causing the residual rearward momentum of the firing pin to initiate firing of the warhead.

6. The method of claim 5 which includes the step of explosively accelerating the plunger rearwardly within the projectile upon firing of the primary fuze.

7. The method of claim 5 which includes the step of causing the residual rearward momentum of the firing pin to explosively initiate firing of the warhead.

* * * * *